US008425257B2

(12) United States Patent
Gao et al.

(10) Patent No.: US 8,425,257 B2
(45) Date of Patent: Apr. 23, 2013

(54) EDGE CONNECTOR FOR SHIELDED ADAPTER

(75) Inventors: Zheng Gao, San Jose, CA (US); George Tziviskos, Cupertino, CA (US); Min Chul Kim, Cupertino, CA (US); Vincent D. Duperron, Cupertino, CA (US); George V. Anastas, Cupertino, CA (US); Gregory A. Springer, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 27 days.

(21) Appl. No.: 13/093,806

(22) Filed: Apr. 25, 2011

(65) Prior Publication Data

US 2012/0270424 A1 Oct. 25, 2012

(51) Int. Cl.
*H01R 13/648* (2006.01)

(52) U.S. Cl.
USPC ..... 439/630; 439/607.17; 439/108; 439/736

(58) Field of Classification Search ..... 439/630, 439/607.17, 108, 736
See application file for complete search history.

(56) References Cited

U.S. PATENT DOCUMENTS

| | | | | |
|---|---|---|---|---|
| 4,544,227 | A * | 10/1985 | Hirose | 439/607.28 |
| 4,900,272 | A * | 2/1990 | Lange et al. | 439/630 |
| 6,948,983 | B1 * | 9/2005 | Peng | 439/660 |
| 7,040,934 | B2 * | 5/2006 | Ling et al. | 439/682 |
| 7,101,200 | B1 * | 9/2006 | Harlan et al. | 439/108 |
| 7,204,717 | B2 * | 4/2007 | Chang et al. | 439/630 |
| 7,357,675 | B2 * | 4/2008 | Barringer et al. | 439/607.3 |
| 7,726,991 | B2 * | 6/2010 | Ma et al. | 439/188 |
| 7,758,356 | B2 * | 7/2010 | Burris et al. | 439/95 |
| 7,891,998 | B1 * | 2/2011 | Gao et al. | 439/159 |
| 7,955,135 | B2 * | 6/2011 | Wang et al. | 439/630 |
| 8,079,876 | B2 * | 12/2011 | Wang et al. | 439/630 |
| 2009/0264018 | A1 * | 10/2009 | Weber et al. | 439/607.17 |

* cited by examiner

*Primary Examiner* — Gary F. Paumen
(74) *Attorney, Agent, or Firm* — Kilpatrick Townsend & Stockton LLP

(57) ABSTRACT

Electrical connections that provide a highly manufacturable, well-shielded path from a cable to a printed circuit board. One example provides a path that includes a card and a connector. Conductors in a cable may be attached to a card. The card may be shielded with a ground plane on one or more sides and edges. The card may insert into a connector that may be attached to a printed circuit board. The connector may include a shield that may have a top portion that forms electrical contact with a ground plane on a top of a card inserted in the connector. The connector may have an opening for accepting the card that is defined by the top portion of the shield and a plurality of rows of contacts. The rows of contacts may include an outer row of ground contacts, and an inner row of signal contacts.

20 Claims, 6 Drawing Sheets

EDGE CONNECTOR FOR SHIELDED ADAPTER

BACKGROUND

Electronic devices have become ubiquitous the past several years. The number and types of portable computing devices, tablet, desktop, and all-in-one computers, cell, smart, and media phones, storage devices, portable media players, navigation systems, monitors and other devices has increased tremendously, and this increase shows no signs of abating.

These electronic devices often share power and data between each other using a cable. These cables often have a connector plug on each end that mates with connector receptacles on the electronic devices. Such a cable may be left in place for long periods of time, or it may be desirable to disconnect the cable, for example if the cable is not needed for the operation of the device, or if the device is to be moved.

Some devices are not useful, or have limited usefulness, when they are not connected through a cable to another device. For example, a stand-alone monitor—that is, a monitor that cannot generate or wirelessly receive an image—may not be very useful unless it is connected to a device. Also, particularly when the monitor is large and not particularly portable, it may be unimportant that a cable may be disconnected.

In such situations, the cable may be directly connected to the monitor. That is, it may be integrated with the monitor. Such a monitor may be referred to as a tethered device. This may save on costs, since a connector plug and receptacle are not needed. It may reduce size, since a cable may be smaller than a receptacle. It may also provide an enhanced user experience, since the cable cannot become detached and misplaced.

But it may be difficult to connect a cable to a monitor in this way. For example, the cable may carry several high-frequency signals. If these signals are not properly shielded, they may generate noise in the form of electromagnetic interference (EMI). This EMI may degrade images provided by the monitor. Also, simple approaches, such as soldering cable conductors to a main, motherboard, or other printed circuit board, may be undesirable, since such connections may be unreliable and may reduce manufacturing yield.

Thus, what is needed are electrical connections that may provide highly manufacturable, well-shielded paths from cables to a printed circuit boards.

SUMMARY

Accordingly, embodiments of the present invention may provide electrical connections that provide highly manufacturable, well-shielded paths between cables and printed circuit boards. An illustrative embodiment of the present invention provides a path that includes a card and a connector. In this example, conductors in a cable may be attached to a card. This card may be a daughter card. The card may be shielded with a ground plane on one or more sides and edges. In a specific embodiment of the present invention, the card is shielded on a top and one or more sides or edges.

In this illustrative embodiment, the card may insert into a connector that may be attached to a printed circuit board. The connector may include a shield. This shield may have a top portion that forms electrical contact with a ground plane on a top of a card inserted in the connector. The top portion of the shield may be split into several sections to improve the electrical connection to the ground plane of the card. The connector may have an opening for accepting the card that is defined by the top portion of the shield and a plurality of rows of contacts. The top portion of the shield may act to push against the card, bringing the card into contact with the plurality of rows of contacts. The rows of contacts may include an outer row of ground contacts, and an inner row of signal contacts, where the signal contacts may include more ground contacts. The outer row of contacts may include surface mount contacts that emerge from a front of the connector. The inner row of contacts may include surface mount contacts that emerge from a back of the connector.

In various embodiments of the present invention, the connector may attach to a printed circuit board, flexible circuit board, or other appropriate substrate. The printed circuit board may be a main logic board, mother board, or other type of printed circuit board.

Another illustrative embodiment of the present invention provides a signal path that is well-shielded. A specific embodiment of the present invention may provide a card that is shielded on a top and one or more sides or edges. An area below the card may be covered with a ground plane to protect circuitry on a main or motherboard from electromagnetic interference. The card may insert in a connector that has an opening that is defined by a grounded shield on a top and an outer row of ground contacts on the bottom. Additional ground pins may be placed in an inner row of contacts on the bottom. These ground pins may be located on each side of high-speed differential signal pairs. The shield and ground contacts may attach to a ground of a printed circuit board or other appropriate substrate.

Another illustrative embodiment of the present invention provides a path from a cable to a printed circuit board that is readily manufactured. By employing a path according to an embodiment of the present invention, a cable does not need to be attached directly to a printed circuit board or other desired substrate. This avoids yield problems that may require rework when cable conductors are soldered directly to a main logic or motherboard.

In a specific embodiment of the present invention, a connector includes an inner and an outer row of contacts. These contacts may be formed using a simple stamping procedure. The inner row may be smooth without sharp corners for reduced electromagnetic interference. This inner row may be formed with a plastic insert molded portion for easy assembly of the connector.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
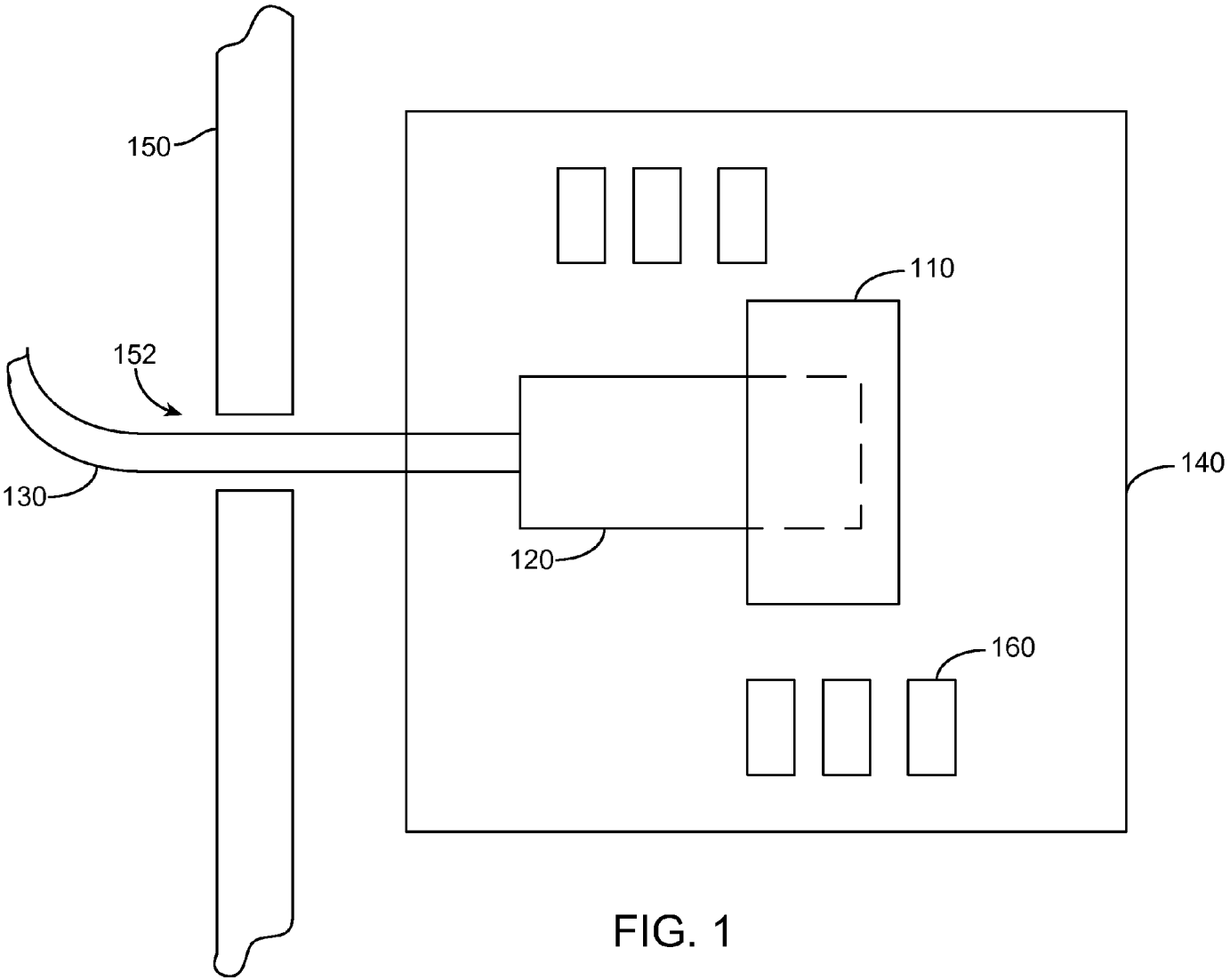
FIG. 1 illustrates a signal path including a card and a connector according to an embodiment of the present invention.

FIG. 1 illustrates a signal path according to an embodiment of the present invention. This figure, as with the other included figures, is shown for illustrative purposes and does not limit either the possible embodiments of the present invention or the claims. Also, while embodiments of the present invention may provide a signal path that includes a card and a connector, other embodiments of the present invention may provide a connector, while others may provide a card.

This signal path may provide a connection between tethered cable 130 and board 140. This signal path may include connector 110 and card 120. Cable 130 may enter an electronic device through opening 152 in housing 150. Cable 130 may be secured in opening 152 by a strain relief (not shown). Cable 130 may attach to card 120. Card 120 may, in turn, be inserted in connector 110. Contacts in connector 110 may be soldered or otherwise connected to board 140. Board 140 may include other devices, apparatus, circuits, and components, such as devices 160.

More specifically, cable 130 may include a number of conductors (not shown). These conductors may convey power, ground, data, status, control, bias, or other types of signals or voltages. Cable 130 may provide these signals and power to an electronic device enclosed by device enclosure 150. The electronic device may be a portable computing device, tablet, desktop, or all-in-one computer, cell, smart, or media phone, storage device, portable media player, navigation system, monitor or other device. The conductors in cable 130 may be soldered to card 120. Traces (not shown) on card 120 may be routed to form electrical connections with contacts in connector 110. Contacts in connector 110 may be soldered or otherwise connected to traces on board 140. Board 140 may be a main, motherboard, printed circuit board, flexible circuit board, or other appropriate substrate.

In this way, the signal path is easily manufactured and highly reliable. Conductors from cable 130 may only need to attach to card 120. This may avoid the need to connect to conductors in cable 130 directly to board 140. Such connections are troublesome in that they are difficult to form and often have a low yield. This means that finished products often need to be reworked, which is time-consuming and expensive. It may be much easier to rework a bad connection between a conductor and cable 130 and card 120. Also, if a bad connection cannot be reworked, it may be much cheaper to discard cable 130 and card 120 than it would be to discard cable 130 and board 140. This is particularly true if components 160 are expensive.

Embodiments of the present invention may also provide a highly-shielded signal path between cable 130 and board 140. A side view illustrating an illustrative embodiment of the present invention is shown in the following figure.

Figure 2:
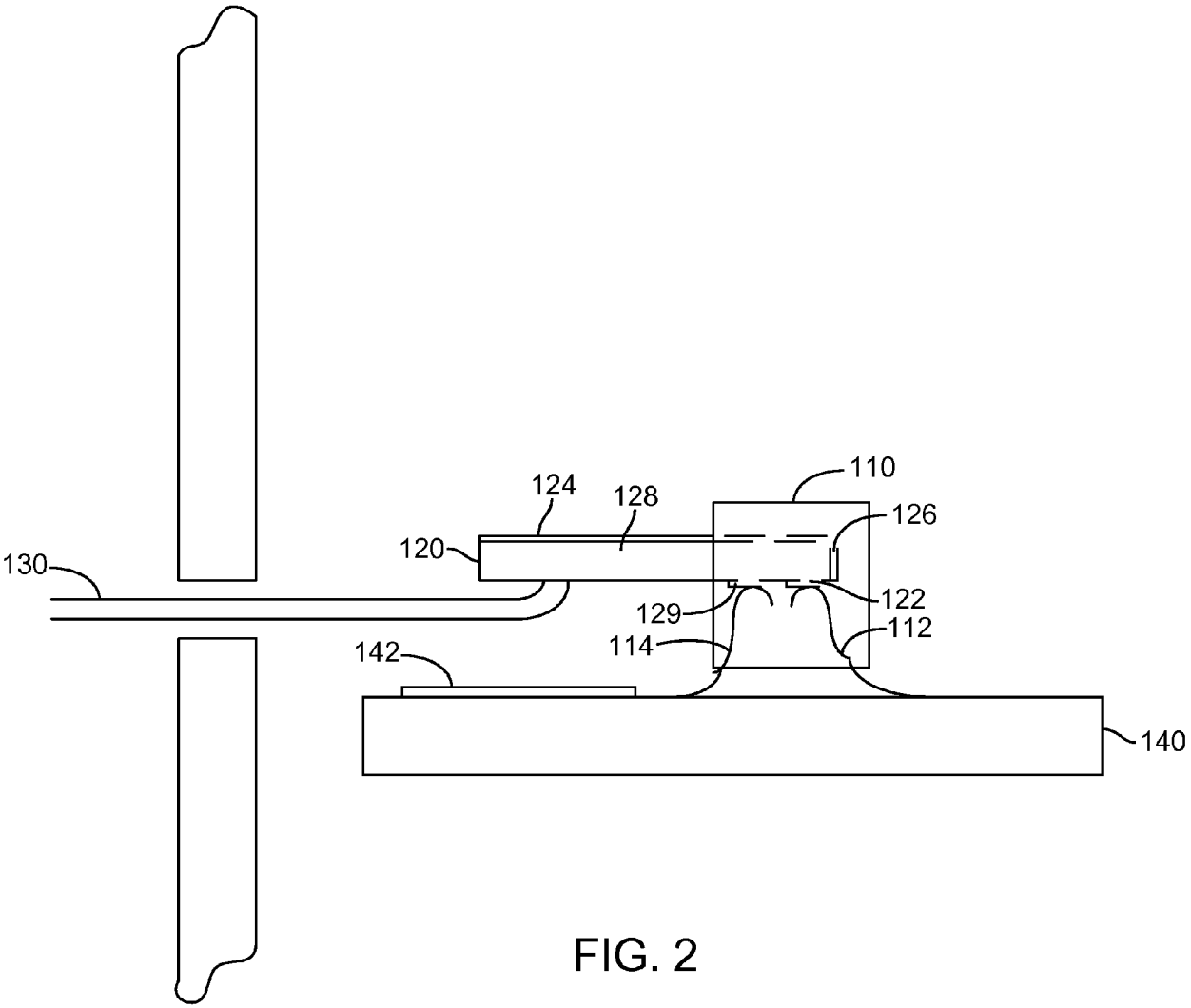
FIG. 2 illustrates a side view of a signal path according to an embodiment of the present invention.

FIG. 2 illustrates a side view of a signal path according to an embodiment of the present invention. Again, this signal path may provide a well-shielded path between cable 130 and board 140. As before, conductors in cable 130 may attach to card 120. These connectors may attach to a top, bottom, or sides of card 120. Traces (not shown) on card 120 may be routed to pads 122. Pads 122 may mate with contacts 112 in the connector 110 when card 120 is inserted in connector 110. Contacts 112 may be soldered or may otherwise form electrical connections with traces (not shown) on board 140. These traces may, in turn, connect to other devices, such as devices 160.

This signal path may be well-shielded. For example, a top side of card 120 may be at least substantially covered with ground plane 124. Ground plane 124 may cover one or more ends 126 and one or more sides 128. Ground plane 124 may attach to a shield (not shown) that may substantially surround connector 110. This shield may attach to a ground plane that is on or associated with board 140. Ground pad 129 on card 120 may form electrical connections with contacts 114 in connector 110. Contacts 114 may be soldered to or may otherwise form an electrical connection with the ground plane on or associated with board 140. A portion of this ground plane is shown here as ground plane portion 142. Ground plane portion 142 may be placed under some or all of card 120 to provide further shielding.

In this way, high-speed signals on cable 130 may be well-shielded. Specifically, connectors inside cable 130 may be shielded by a braiding layer (not shown). This braiding layer may be soldered, crimped, or otherwise connected to a ground on card 120. After these conductors connect to board 120, they may be at least partially surrounded by a ground plane layer 124 on a top side of card 120, and ground plane portion 142 on a top side of board 140. Inside connector 110, contacts 112 may be shielded by a shield (not shown) surrounding connector 110 and contacts 114, which again may be connected to the ground plane on or associated with board 140. In this way, two, more than two, or all of the braiding of cable 130, ground plane 124 on card 120, ground pad 129 (along with possibly one or more pads 122), the shield around connector 110, contacts 114 (and possibly one or more contacts 112), ground plane portion 142, and other ground planes or grounds on or associated with board 140, may be connected to each other as a ground. This ground may provide shielding and EMI protection for signals in a signal path according to an embodiment of the present invention.

Embodiments of the present invention may provide a connector having an opening that is defined on top by a shield portion and on a bottom by multiple rows of contacts. An example is shown in the following figure.

Figure 3:
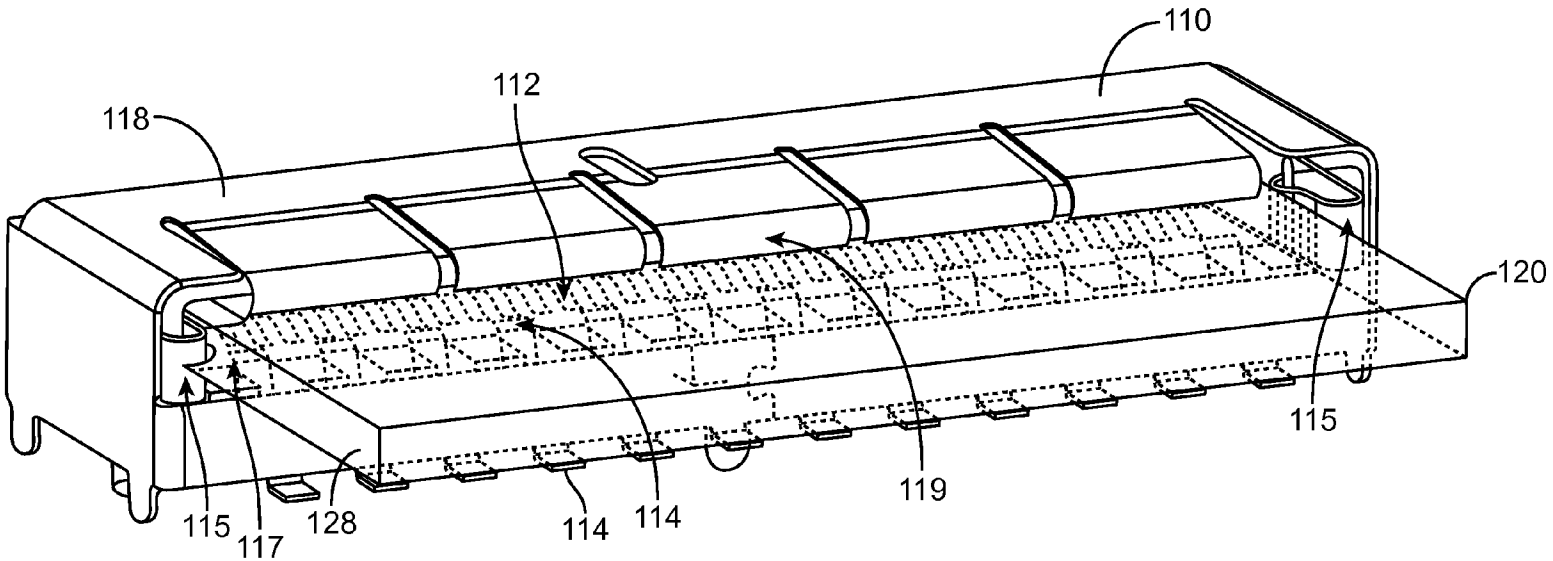
FIG. 3 illustrates a connector according to an embodiment of the present invention.

FIG. 3 illustrates a connector 110 according to an embodiment of the present invention. Connector 110 is shown as accepting card 120. Connector 110 may be substantially surrounded by shield 118. Shield 118 may include a top portion 119 to define a top of an opening 117. Top portion 119 may be somewhat angled or bent down and folded back under itself and into opening 117 in connector 110. In this way, front portion 119 may make a good electrical contact with a ground plane (not shown) on a top side of card 120. Front portion 119 may be split into several sections to improve this electrical connection. Front portion 119 may also act as a spring to force card 120 downward, such that pads 122 and 129 form good electrical connections with contacts 112 and 114. Shield 118 may also include side portions 115 on one or more sides of opening 117. Side portions 115 may also be folded back into opening 117. Side portions 115 may form electrical connections with contacts or a ground plane on one or more sides 128 of card 120.

A bottom side of opening 117 may be defined by an outer row of contacts 114. This outer row of contacts may be arranged to be connected to ground, such as shield 118, a ground plane on or associated with a ground plane on board 140, or both. These contacts may be surface mount contacts that emerge from a front of connector 110. In other embodiments of the present invention, these contacts may be through-hole contacts or other types of contacts.

A bottom side of opening 117 may be further defined by an inner row of contacts 112. This inner row of contacts 112 may be arranged to convey data, control, status, bias, power, ground, and other types of signals and power supplies. In a specific embodiment of the present invention, these contacts may convey one or more differential pairs of signals. These differential pairs may each be arranged to be conveyed on a pair of adjacent contacts that have contacts conveying ground or other low impedance signals (such as power, control, status, bias, or other signals) on each side of the pair. This may further improve shielding of these differential signals through the signal path.

Again, outer-row contacts 114 may be each connected to a ground plane on or associated with board 140. Because of this, contacts 140 may be connected together. Connecting these contacts together may make assembly of connector 110 easier, since contacts 114 do not have to be handled individually. An example is shown in the following figure.

Figure 4:
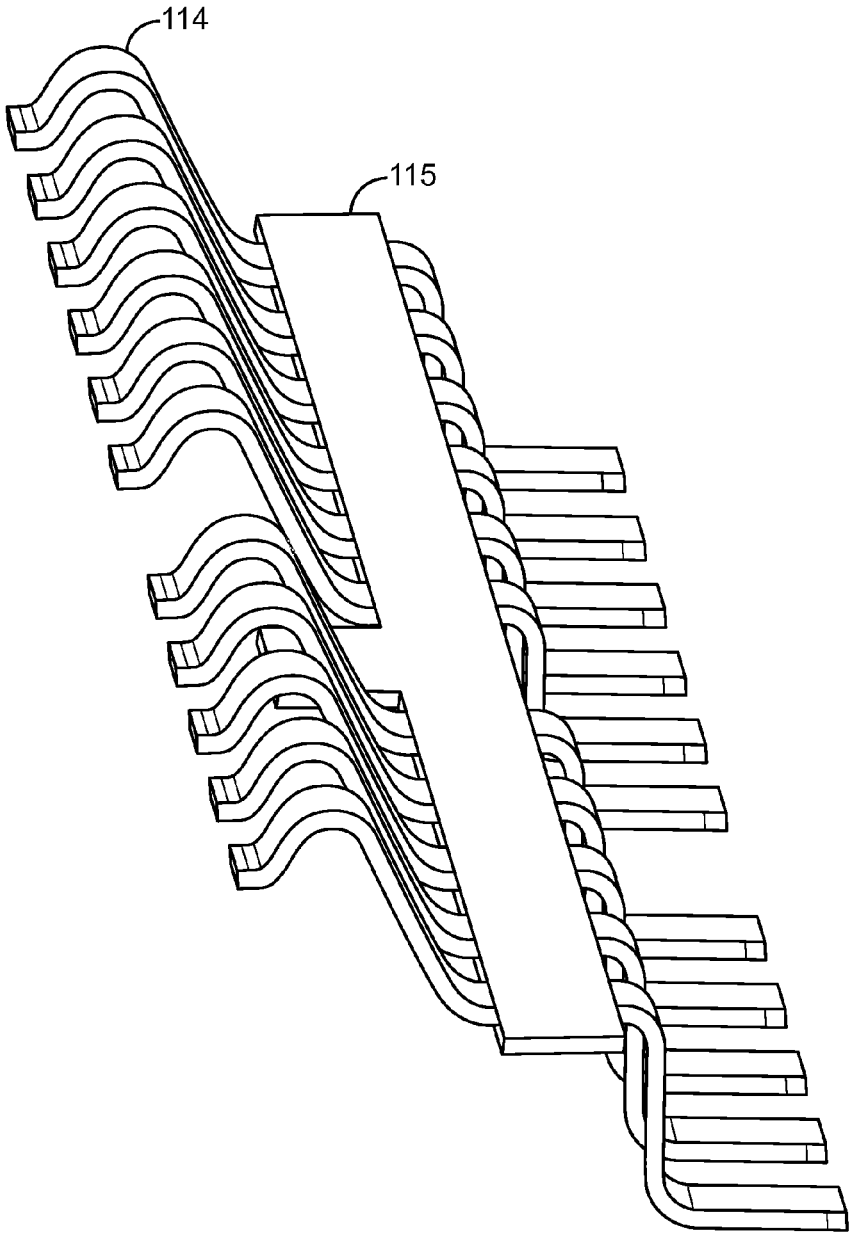
FIG. 4 illustrates a set of outer-row contacts according to an embodiment of the present invention.

FIG. 4 illustrates a set of outer-row contacts 114 according to an embodiment of the present invention. Again, these contacts may be electrically connected to each other by portion 115. These contacts may be surface mount contacts, through-hole contacts, or other types of contacts.

To reduce EMI, inner-row contacts 112 may be substantially free of sharp edges or corners. An example is shown in the following figure.

Figure 5:
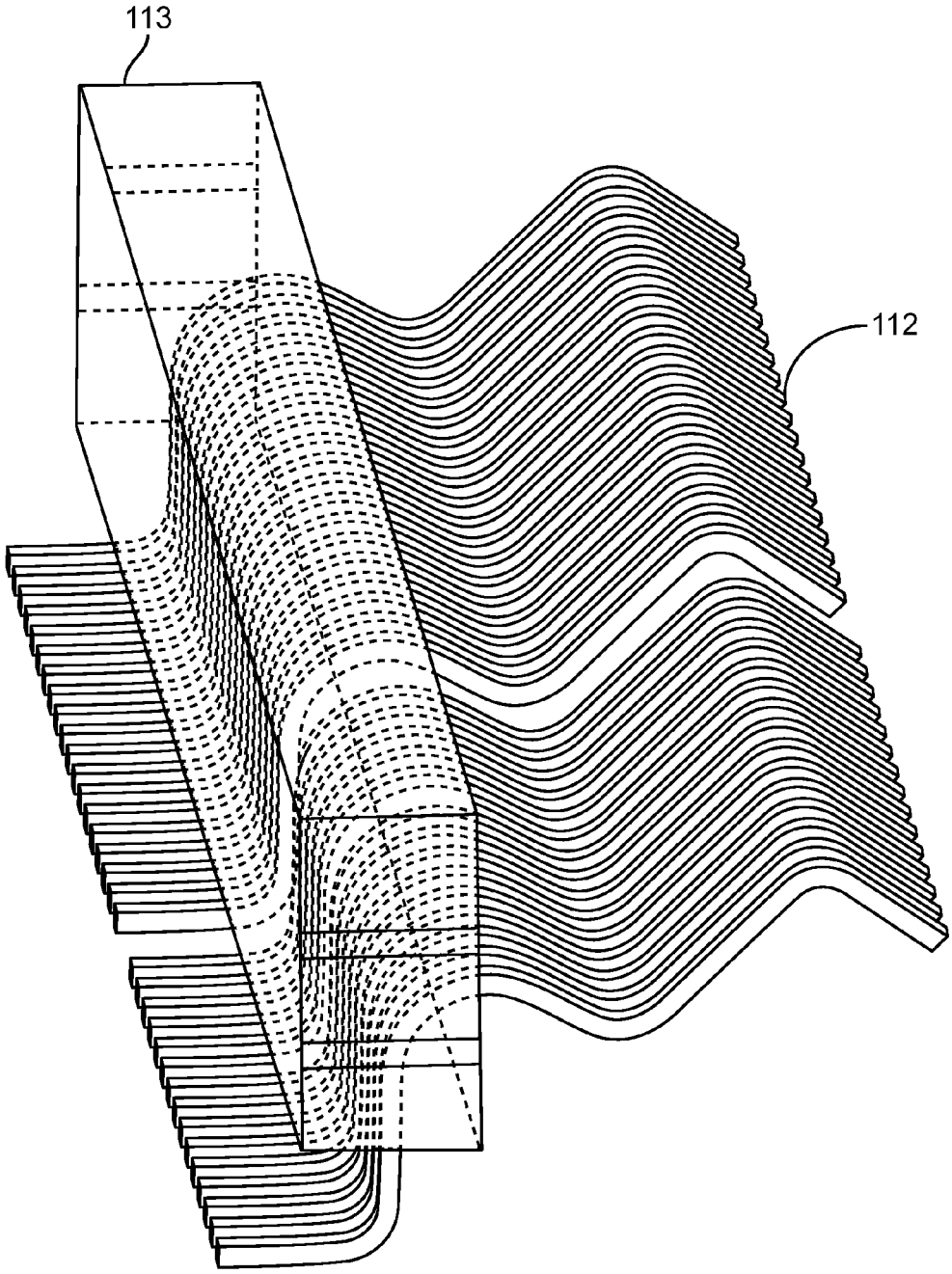
FIG. 5 illustrates a set of inner-row contacts according to an embodiment of the present invention.

FIG. 5 illustrates a set of inner-row contacts 112 according to an embodiment of the present invention. These contacts may be substantially free of sharp edges or corners. An injection molded portion 113 may be used to secure contacts 112 together. This may make assembly of connector 110 easier, since contacts 112 do not have to be handled individually.

Again, inner-row contacts 112 may form electrical connections with pads on card 120, while outer-row contacts 114 may form electrical connection with ground pads, a ground pad, or a ground plane portion on card 120. An example is shown in the following figure.

Figure 6:
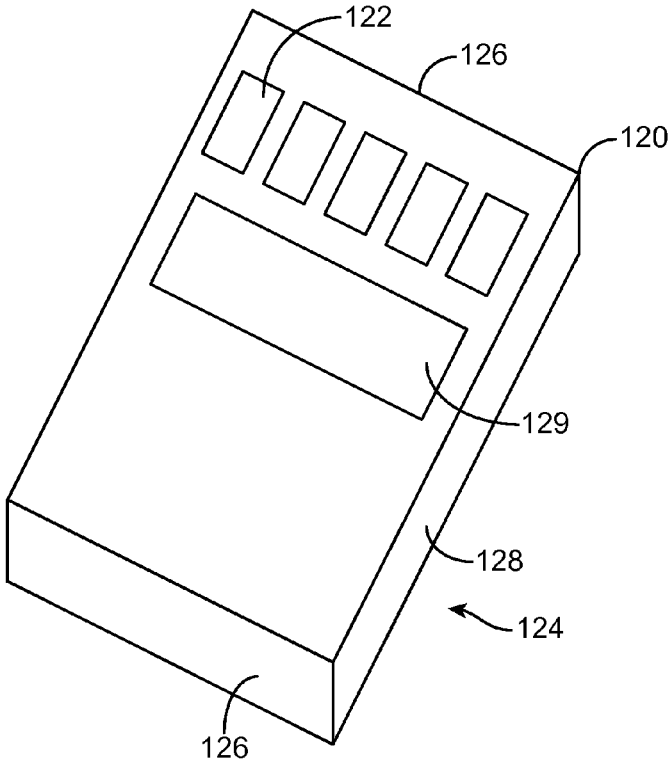
FIG. 6 illustrates a bottom view of a card according to an embodiment of the present invention.

FIG. 6 illustrates a bottom view of card 120 according to an embodiment of the present invention. Card 120 may include pads 122 that may mate with contacts 112 in connector 110 when card 120 is inserted into connector 110. Card 120 may further include ground pad 129. Ground pad 129 may be a separate ground pad, or it may be a part of a ground plane on or associated with card 120. Card 120 may be further at least substantially covered by a ground plane on top 124 of card 120 (the underside as viewed). Again, this ground plane may connect to top portion 119 of shield 118 when card 120 is inserted into connector 110. One or more sides 128 and ends 126 may also be at least substantially covered by this ground plane. The sides 128 may connect to side portions 115 of connector 110 when card 120 is inserted into connector 110.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a shield substantially forming a housing for the connector, the shield forming a top of an opening, the opening in a front of the connector, wherein the top of the opening forms a plurality of contacts to form electrical connections with a ground plane on a top side of a card when the card is inserted into the connector;

an outer row of contacts defining a bottom of the opening, the outer row of contacts emerging from a front of the connector; and an inner row of contacts defining the bottom of the opening and located between the outer row of contacts and a back of the connector, the inner row of contacts emerging from the back of the connector.

2. The connector of claim 1 wherein the outer row of contacts are connected together.

3. The connector of claim 1 wherein contacts in the outer row of contacts are wider than contacts in the inner row of contacts.

4. The connector of claim 1 wherein the shield is bent at a front of the opening such that a portion of the shield is folded below a top of the shield.

5. The connector of claim 4 wherein a top portion of the shield is split into several sections.

6. The connector of claim 4 wherein the shield is bent at each side of the opening such that portions of the shield are folded into the opening in the front of the connector.

7. The connector of claim 1 wherein the inner row of contacts include signal contacts.

8. The connector of claim 1 wherein the inner row of contacts are free of sharp corners.

9. The connector of claim 1 wherein the inner row of contacts are substantially free of sharp corners.

10. The connector of claim 1 further comprising an injection molded portion around a portion of each of the inner row of contacts.

11. A connector comprising:

a shield portion forming a top row of contacts along a top of an opening, wherein the top row of contacts form electrical connections with a ground on a top side of a card when the card is inserted into the connector;

an outer bottom row of contacts along a bottom of the opening; and an inner bottom row of contacts along the bottom of the opening.

12. The connector of claim 11 wherein the opening is in a front of the connector, and the outer bottom row of contacts emerge from the front of the connector.

13. The connector of claim 12 wherein the inner bottom row of contacts is located between the outer bottom row of contacts and a back of the connector, and the inner bottom row of contacts emerge from a back of the connector.

14. The connector of claim 13 wherein the outer bottom row of contacts are surface mount contacts.

15. The connector of claim 14 wherein the inner bottom row of contacts are surface mount contacts.

16. The connector of claim 15 wherein the shield portion forms at least one contact on each of a right and left side of the opening.

17. A signal path comprising:

a connector comprising:

a shield portion forming a top row of contacts along a top of an opening;

an outer bottom row of contacts along a bottom of the opening; and an inner bottom row of contacts along the bottom of the opening; and a card to fit in the opening in the connector, the card comprising:

a ground plane substantially covering a top of the card to form electrical connections with the top row of contacts;

a plurality of pads on a bottom of the card to form electrical connections with the inner bottom row of contacts in the connector;

a ground pad on the bottom of the card to form electrical connections with the outer bottom row of contacts.

18. The signal path of claim 17 wherein the shield portion forms at least one contact on each of a right and left side of the opening in the connector, and the ground plane of the card substantially covers a right and left edge of the card.

19. The signal path of claim 17 wherein the card further comprises a plurality of pads to be soldered to conductors of a cable.

20. The signal path of claim 17 wherein the inner bottom row of contacts is located between the outer bottom row of contacts and a back of the connector, and the inner bottom row of contacts emerge from a back of the connector.

* * * * *